US011678693B2

(12) United States Patent
Guo

(10) Patent No.: US 11,678,693 B2
(45) Date of Patent: Jun. 20, 2023

(54) ELECTRONIC CIGARETTE CAPABLE OF FORMING SMOKE RINGS

(71) Applicant: Shenzhen Bijiang Technology Co., Ltd., Shenzhen (CN)

(72) Inventor: Boyang Guo, Changde (CN)

(73) Assignee: SHENZHEN BIJIANG TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 17/878,941

(22) Filed: Aug. 2, 2022

(65) Prior Publication Data

US 2022/0369697 A1 Nov. 24, 2022

Related U.S. Application Data

(63) Continuation of application No. PCT/CN2020/140582, filed on Dec. 29, 2020.

(30) Foreign Application Priority Data

Feb. 3, 2020 (CN) ..... 202020151151.8

(51) Int. Cl.
*A24F 13/00* (2006.01)
*A24D 1/20* (2020.01)

(52) U.S. Cl.
CPC ..... *A24D 1/20* (2020.01)

(58) Field of Classification Search
CPC ..... A24F 47/00
USPC ..... 131/328–329
See application file for complete search history.

(56) References Cited

U.S. PATENT DOCUMENTS

2002/0071664 A1 6/2002 Aronie
2017/0196265 A1* 7/2017 Liu ..... F16K 15/023
2019/0092559 A1* 3/2019 Faircloth ..... B65D 85/109

FOREIGN PATENT DOCUMENTS

CN 205867604 U 1/2017
CN 107149169 A 9/2017
CN 207100528 U 3/2018
CN 207306078 U 5/2018
CN 207808875 U 9/2018
CN 110360879 A 10/2019
CN 211832834 U 11/2020

OTHER PUBLICATIONS

International Search Report for PCT/CN2020/140582.
Written Opinion of the International Searching Authority for PCT/CN2020/140582.

* cited by examiner

*Primary Examiner* — Phuong K Dinh

(57) ABSTRACT

An electronic cigarette includes a cigarette holder, a pipe body, an electronic cigarette atomizer, a hand-pushing cylinder component, a first spring, a second spring, a third spring, a movable support, an impact rod, an elastic film, a sealing cover, and a smoke pipe. The cigarette holder is disposed at a first end of the pipe body through the electronic cigarette atomizer, and the sealing cover is disposed at a second end of the pipe body. The hand-pushing cylinder component is sleeved on an outer side of the pipe body through the first spring. The elastic film is fixed in the pipe body along a radial direction of the pipe body. The impact rod is disposed in the pipe body through the second spring and the impact rod is disposed on one side, facing the cigarette holder, of the elastic film.

7 Claims, 1 Drawing Sheet

ELECTRONIC CIGARETTE CAPABLE OF FORMING SMOKE RINGS

CROSS REFERENCE

The present application is a continuation-application of International (PCT) Patent Application No. PCT/CN2020/140582, filed on Dec. 29, 2020, which claims foreign priorities of Chinese Patent Application No 202020151151.8, filed on Feb. 3, 2020, the entire contents of which are hereby incorporated by reference.

TECHNICAL FIELD

The present disclosure relates to a field of electronic cigarettes, and in particular to an electronic cigarette capable of forming smoke rings.

BACKGROUND

At present, electronic cigarettes are well known to have function of smoking, but the electronic cigarettes cannot form smoke rings as using real cigarettes, which does not have enough playability and may affect user experience.

SUMMARY

The present disclosure provides an electronic cigarette to solve at least one of above technical problems.

In order to solve the above problems, the present disclosure provides an electronic cigarette, including a cigarette holder, a pipe body, an electronic cigarette atomizer, a hand-pushing cylinder component, a first spring, a second spring, a third spring, a movable support, an impact rod, an elastic film, a sealing cover, and a smoke pipe. The cigarette holder is disposed at a first end of the pipe body through the electronic cigarette atomizer, and the sealing cover is disposed at a second end of the pipe body. The hand-pushing cylinder component is sleeved on an outer side of the pipe body through the first spring. The elastic film is fixed in the pipe body along a radial direction of the pipe body. The impact rod is disposed in the pipe body through the second spring and the impact rod is disposed on one side, facing the cigarette holder, of the elastic film. A first end of the movable support is pivotally connected to the impact rod, and a second end of the movable support is connected to the impact rod through the third spring. An air bin is formed at a portion of the pipe body, where the portion of the pipe body is between the elastic film and the sealing cover. The smoke pipe is disposed in the pipe body. A first end of the smoke pipe is communicated with the cigarette holder, and a second end of the smoke pipe is communicated with the air bin. A smoke ring forming hole is defined on the sealing cover.

Optionally, a control panel and a battery are disposed in the pipe body, and the battery is configured to supply power to the control panel and the electronic cigarette atomizer.

Optionally, a switch button is disposed on a side wall of the pipe body with respect to a position of the control panel.

Optionally, the electronic cigarette atomizer is connected to the pipe body through a conversion head.

Optionally, the pipe body includes an upper cylinder component, a middle cylinder component, and a lower cylinder component, and the upper cylinder component, the middle cylinder component, and the lower cylinder component are connected in sequence.

Optionally, one end of the movable support is pivotally connected to the impact rod through a fixing pin.

Optionally, the elastic film is an elastic silica gel sheet.

Due to adoption of above technical solutions, the present disclosure provides the electronic cigarette to avoid a monotonous feeling and a problem that only simple smoking function is provided. The electronic cigarette of the present disclosure compresses smoke which is blown out into smoke rings, which improves user experience.

Figure 1:
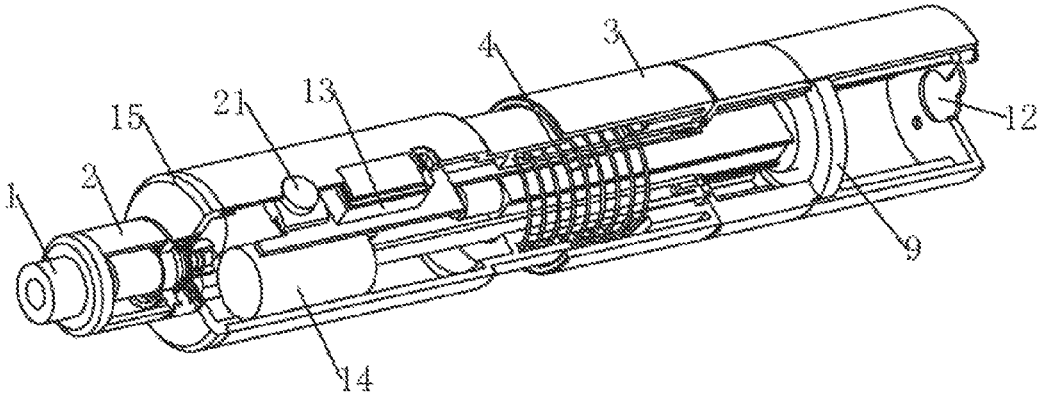
FIG. 1 is a three-dimensional schematic diagram of an electronic cigarette according to one embodiment of the present disclosure.
Figure 2:
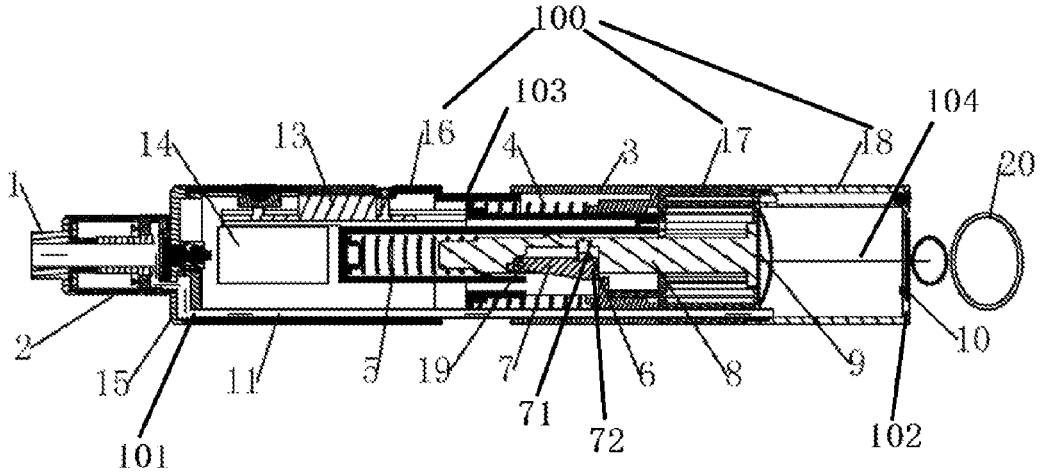
FIG. 2 is a cross-sectional schematic diagram of the electronic cigarette according to one embodiment of the present disclosure.

Reference number in the drawings: 1. cigarette holder; 2. electronic cigarette atomizer; 3. hand-pushing cylinder component; 4. first spring; 5. second spring; 6. third spring; 7. movable support; 8, impact rod; 9. elastic film; 10. sealing cover; 11. smoke pipe; 12. smoke ring forming hole; 13. control panel; 14. battery; 15. conversion head; 16. upper cylinder component; 17. middle cylinder component; 18. lower cylinder component; 19. fixing pin; 20. smoke rings; and 21. switch button.

DETAILED DESCRIPTION

Embodiments of the present disclosure are described in details below with reference to accompanying: drawings, but the present disclosure is implemented in a plurality of different manners defined and covered by the claims.

The present disclosure provides an electronic cigarette, including a cigarette holder 1, a pipe body 100, an electronic cigarette atomizer 2, a hand-pushing cylinder component 3, a first spring 4, a second spring 5, a third spring 6, a movable support 7, an impact rod 8, an elastic film 9, a sealing cover 10, and a smoke pipe 11. The cigarette holder 1 is disposed at a first end of the pipe body 101 through the electronic cigarette atomizer 2, and the sealing cover 10 is disposed at a second end of the pipe body 102. The hand-pushing cylinder component 3 is sleeved on an outer side of the pipe body 103 through the first spring 4. The elastic film 9 is fixed in the pipe body 100 along a radial direction of the pipe body 100. The impact rod 8 is disposed in the pipe body 100 through the second spring 5 and the impact rod 8 is disposed on one side, facing the cigarette holder 1, of the elastic film 9. A first end of the movable support 71 is pivotally connected to the impact rod 8, and a second end of the movable support 72 is connected to the impact rod 8 through the third spring 6. An air bin 104 is formed at a portion of the pipe body 100, where the portion of the pipe body is between the elastic film 9 and the sealing cover 10. The smoke pipe 11 is disposed in the pipe body. A first end of the smoke pipe 11 is communicated with the cigarette holder 1, and a second end of the smoke pipe 11 is communicated with the air bin 104. A smoke ring forming hole 12 is defined on the sealing cover 10.

Optionally, the electronic cigarette atomizer 2 is connected to the pipe body through a conversion head 15. Optionally, the pipe body includes an upper cylinder component 16, a middle cylinder component 17, and a lower cylinder component 18, and the upper cylinder component 16, the middle cylinder component 17, and the lower cylinder component 18 are connected in sequence. Optionally, the elastic film 9 is an elastic silica gel sheet. Optionally, one end of the movable support 7 is pivotally connected to the impact rod 8 through a fixing pin 19.

Optionally, a control panel 13 and a battery 14 are disposed in the pipe body, and the battery 14 is configured to supply power to the control panel 13 and the electronic cigarette atomizer 2. Optionally, a switch button 21 is disposed on a side wall of the pipe body with respect to a position of the control panel 13. The switch button 21 turns on the electronic cigarette atomizer 2.

In a normal working state of the electronic cigarette atomizer 2. the switch button 21 is pressed, and the cigarette holder 1 is hold through mouth to blow out smoke into the lower cylinder component 18. When the smoke is fully filled in the lower cylinder component 18, blowing is stopped, the silicone sealing cover 10 is lifted, the upper cylinder component 16 is hold through a left hand, the hand-pushing cylinder component 3 is hold through a right hand, and the hand-pushing cylinder component 3 is pushed in a direction of the upper cylinder component 16. At this time, a front end surface of the movable support 7 is hooked through the hand-pushing cylinder component 3, and since the movable support 7 is connected to the impact rod 8 through the fixing pin 19, thereby, in a pushing process. the impact rod 8 is driven to move in the direction of the upper cylinder component 16.

When the impact rod 8 is moved until the hand-pushing cylinder component 3 separates from the movable support 7, the impact rod 8 impacts the elastic film 9 under a resilience force action of the second spring 5, the elastic film 9 is stressed to stretch and raise under an action force of the impact rod 8, the smoke in the lower cylinder component 18 forms smoke rings 20 from the smoke ring forming hole 12 at a front end of the lower cylinder component 18 under an instant force action. In this way, the smoke rings are continuously puffed out, which achieves novel playing effect.

Due to adoption of above technical solutions, the present disclosure provides the electronic cigarette to avoid a monotonous feeling and a problem that only simple smoking function is provided. The electronic cigarette of the present disclosure compresses the smoke which is blown out into the smoke rings, which improves user experience. The present disclosure not only has the smoking function, but also increases an electronic cigarette device that compresses the smoke which is blown out into the smoke rings, which greatly enhances playability.

Above descriptions are only the preferred embodiments of the present disclosure and are not intended to limit the present disclosure. For those skilled in art, various changes are made in the present disclosure. Any modification, equivalent replacement, improvement and the like made within spirit and principle of the present disclosure should be included in a protection scope of the present disclosure.

What is claimed is:

1. An electronic cigarette, comprising:
a cigarette holder;
a pipe body;
an electronic cigarette atomizer;
a hand-pushing cylinder component;
a first spring;
a second spring;
a third spring;
a movable support;
an impact rod;
an elastic film;
a sealing cover; and
a smoke pipe;
wherein the cigarette holder is disposed at a first end of the pipe body through the electronic cigarette atomizer, the sealing cover is disposed at a second end of the pipe body; the hand-pushing cylinder component is sleeved on an outer side of the pipe body through the first spring, the elastic film is fixed in the pipe body along a radial direction of the pipe body, the impact rod is disposed in the pipe body through the second spring and the impact rod is disposed on one side, facing the cigarette holder, of the elastic film; a first end of the movable support is pivotally connected to the impact rod, a second end of the movable support is connected to the impact rod through the third spring; an air bin is formed at a portion of the pipe body, where the portion of the pipe body is between the elastic film and the sealing cover, the smoke pipe is disposed in the pipe body, a first end of the smoke pipe is communicated with the cigarette holder, a second end of the smoke pipe is communicated with the air bin; and a smoke ring forming hole is defined on the sealing cover.

2. The electronic cigarette according to claim 1, wherein a control panel and a battery are disposed in the pipe body, and the battery is configured to supply power to the control panel and the electronic cigarette atomizer.

3. The electronic cigarette according to claim 2, wherein a switch button is disposed on a side wall of the pipe body with respect to a position of the control panel.

4. The electronic cigarette according to claim 1, wherein the electronic cigarette atomizer is connected to the pipe body through a conversion head.

5. The electronic cigarette according to claim 1, wherein the pipe body comprises an upper cylinder component, a middle cylinder component, and a lower cylinder component; and the upper cylinder component, the middle cylinder component, and the lower cylinder component are connected in sequence.

6. The electronic cigarette according to claim 1, wherein one end of the movable support is pivotally connected to the impact rod through a fixing pin.

7. The electronic cigarette according to claim 1, wherein the elastic film is an elastic silica gel sheet.

* * * * *